US008132836B2

(12) United States Patent
Chen

(10) Patent No.: US 8,132,836 B2
(45) Date of Patent: Mar. 13, 2012

(54) BALL COLLECTING DEVICE

(75) Inventor: Yu-Gang Chen, Yongkang (TW)

(73) Assignee: Far East University, Hsin-Shih (TW)

( * ) Notice: Subject to any disclaimer, the term of this patent is extended or adjusted under 35 U.S.C. 154(b) by 235 days.

(21) Appl. No.: 12/502,203

(22) Filed: Jul. 13, 2009

(65) Prior Publication Data

US 2010/0016102 A1 Jan. 21, 2010

(30) Foreign Application Priority Data

Jul. 15, 2008 (TW) ..... 97126856 A
Jun. 17, 2009 (TW) ..... 98120308 A

(51) Int. Cl.
*A63B 47/02* (2006.01)

(52) U.S. Cl. ..... 294/19.2; 414/440

(58) Field of Classification Search ..... 294/19.2; 414/338, 440; 56/328.1; 301/37.25
See application file for complete search history.

(56) References Cited

U.S. PATENT DOCUMENTS 3,306,480 A * 2/1967 Wysong ..... 414/440
4,077,194 A * 3/1978 Livingston ..... 56/328.1
4,593,519 A * 6/1986 Kimball ..... 56/328.1
4,645,254 A * 2/1987 Warden ..... 294/19.2
4,991,896 A * 2/1991 Martin ..... 294/19.2
5,152,565 A * 10/1992 Dodd ..... 294/19.2
7,341,294 B2 * 3/2008 Olmstead ..... 294/19.2
7,462,010 B1 * 12/2008 Wittek et al. ..... 414/440
2005/0168051 A1 * 8/2005 Wang ..... 301/37.25

FOREIGN PATENT DOCUMENTS

TW 497434 8/2002
TW M284412 1/2006

* cited by examiner

*Primary Examiner* — Saul Rodriguez
*Assistant Examiner* — Stephen Vu
(74) *Attorney, Agent, or Firm* — Wang Law Firm, Inc.; Li K. Wang

(57) ABSTRACT

A ball collecting device comprising a drum and a control element. A first cover and a second cover are installed at both ends of the drum respectively to form a containing space in the drum. The first cover and the second cover are hollow and connected to at least one ring-shaped body with an interval apart. Each ring-shaped body comprises at least one elastic element installed around the ring-shaped body. The first cover, the second cover and the ring-shaped bodies are connected by at least one rod. The control element is connected to the drum and provided for a user to hold and push the drum to roll. An elastic element installed around the second cover is provided for pushing at least one ball to shift and enter into the containing space for storage, so as to provide a convenient way of collecting balls.

8 Claims, 4 Drawing Sheets

BALL COLLECTING DEVICE

BACKGROUND OF THE INVENTION

1. Field of the Invention

The present invention relates to a ball collecting device, in particular to a ball collecting device having a hollow drum and circular elastic elements for forcing a ball to shift the circular elastic elements and then squeezing the ball into the drum, so as to achieve the effect of collecting and storing the ball.

2. Description of the Related Art

At present, our living standard rises and we pay more attention to our physical health conditions, such that leisure activities and sports have caught our attention, and various ball games such as golf, baseball, table tennis and tennis have become popular games. In the aforementioned ball games, a large number of balls are used for practicing and drilling basic movements. Thus, many balls will be scattered to every corners of a training court, and a person who picks the balls has to bend down to pick up the balls and put the balls into a basket or a bucket repeatedly. However, this way of collecting balls usually takes much time and consumes much physical strength, and the way of picking up the balls repeated by hands not just makes the picker's hand dirty, but also causes pains or injuries to the picker's lower back.

A structure of a roller type ball collector has been disclosed in TW Pat. No. M284412, and the structure comprises a movable stand and a hollow basket with a plurality of elastic wires installed with an interval apart from one another and around the basket. An openable upper casing and a lower casing are installed at both ends of the basket respectively to form a containing space in the basket, such that the flexibility of the plurality of elastic wires is used for driving at least one ball to enter into the containing space and the ball will not fall out. In addition, a pivoting hole is formed respectively at the center of the upper casing and the lower casing for pivotally connecting an end extended from the movable stand, and a handle is installed at another end, so as to form the structure having the ball collection function. Further, the lower casing comprises a group of connecting holes provided for inserting a pin extended from the movable stand, and the handle is used as a base for erecting the ball collector to form a ball storage rack, so that a player can take out a ball easily from the ball storage rack for practices.

In addition, a ball collecting apparatus as disclosed in TW. Pat. No. 497434 comprises a pipe, a contractible spring, an arch rack, a push rod, a ball collection, cylinder, a semicircular frame and a contractible band. An upper section of the pipe is pivotally connected to a bottom end of a lower section of the arch rack, and the upper section of the pipe is linked with the middle of the lower section of the arch rack by the contractible spring, such that the arch rack can be turned downwardly and then resumed to its original position. An opening is formed at the middle of the pipe, and a clamping cylinder is formed and cut from both sides of the lower section for sheathing and clamping the ball collection cylinder. A rear semicircular bottom of the ball collection cylinder is pivotally coupled to the semicircular frame, and the plurality of contractible bands are tied with an appropriate interval apart from one another and on both sides of the center of the semicircular frame respectively. Other ends of the contractible bands are symmetrically tied to strip holes with an appropriate distance apart from each other at a front semicircular front of the ball collection cylinder. An upper end of the push rod is fixed by a sheathe that is positioned by the arch rack, and the bottom end of the push rod is passed through the opening of the pipe, extended out from the clamping cylinder and fixed to the center of the semicircular frame. The ball collection cylinder is pressed and covered onto table-tennis balls scattered over the ground of a court. The appropriate interval between two contractible bands and the flexibility of the contractible bands can be used for spreading the contractible bands apart according to the arc of the table-tennis balls and allowing the table-tennis balls to slide into the ball collection cylinder, and then the two contractible bands will resume their original positions to prevent the table-tennis balls from falling out. When the arch rack is turned downwardly, the push rod of an appropriate hardness pushes the semicircular frame down to open the ball collection cylinder and allows the table-tennis ball to fall out automatically, so as to provide a quick and convenient way of collecting and releasing the table-tennis balls.

In view of the drawbacks of the prior art, the inventor of the present invention based on years of experience in the related industry to conduct extensive researches and experiments, and finally developed a ball collecting device in accordance with the present invention to overcome the aforementioned issues of the prior art.

SUMMARY OF THE INVENTION

It is a primary objective of the present invention to overcome the aforementioned issues of the prior art by providing a ball collecting device to pick up balls scattered all over a court.

Another objective of the present invention is to provide a ball collecting device comprising a drum and a control element. A first cover and a second cover are installed at both ends of the dram respectively, such that a containing space is formed in the drum. The drum has a hollow trunk and is connected to at least one ring-shaped body with an interval apart, and at least one elastic element is installed around each of the ring-shaped bodies. The first cover, the second cover and the ring-shaped bodies are connected by at least one rod. The control element is connected to the drum and provided for users to hold and push the drum to roll.

At least one ring-shaped body is connected to the drum with an interval apart, and an elastic element is installed around each ring-shaped body, such that the circular elastic element of the ring-shaped body can be used to push at least one ball to shift and enter into the containing space for storage, so as to provide a convenient way of picking and collecting the balls.

The present invention further provides a ball collecting device comprising a drum and a control element. A first cover and a second cover are installed at both ends of the drum, such that a containing space is formed in the drum. At least one elastic element is installed around the second cover. The first cover, the second cover and each ring-shaped body are disposed separately from on another with an interval apart, and are connected serially by at least one rod, and the control element is connected separately to both ends of the drum.

In summation of the description above, the bail collecting device of the present invention has one or more of the following advantages:

(1) The ball collecting device can limit the positions of the balls by the circular elastic element to improve the convenience of storing the balls into the drum.

(2) The ball collecting device can push the balls to shift and enter into the containing space for storage by the circular elastic element, so as to solve the problem of picking up the balls scattered over a court.

To make it easier for our examiner to understand the objective of the invention, its structure, innovative features, and performance, we use a preferred embodiment together with the attached drawings for the detailed description of the invention.

DETAILED DESCRIPTION OF THE PREFERRED EMBODIMENTS

The present invention will now be described in more detail hereinafter with reference to the accompanying drawings that show various embodiments of the invention, and same numerals are used for same respective elements for simplicity and consistence.

Figure 1:
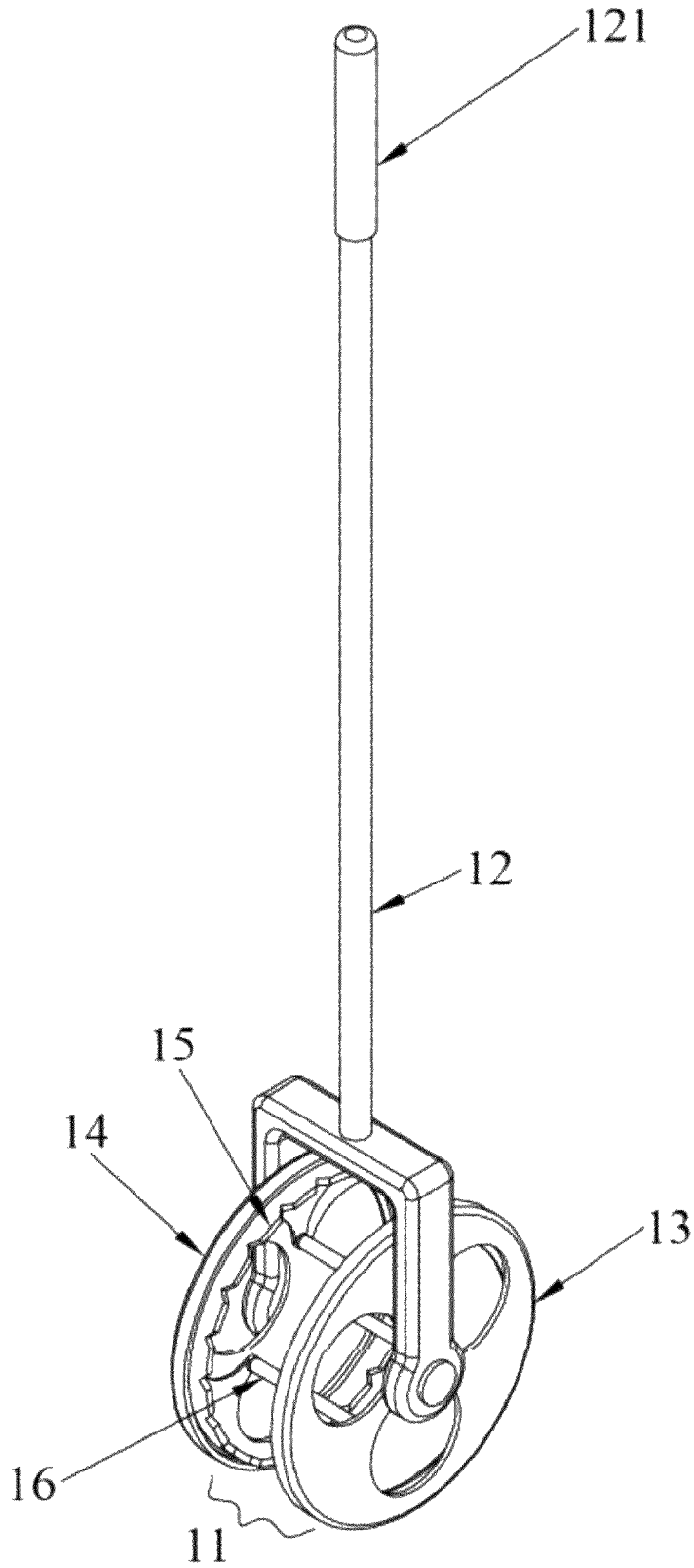
FIG. 1 is a schematic view of a ball collecting device in accordance with an embodiment of the present invention.

With reference to FIG. 1 for a schematic view of a ball collecting device in accordance with an embodiment of the present invention, the ball collecting device comprises a drum 11 and a control element 12. A first cover 13 and a second cover 14 are installed at both ends of drum 11 respectively such that the first cover 13 and the second cover 14 form a containing space in the drum 11. At least one elastic element 15 is installed around the second cover 14, and the first cover 13 and the second cover 14 are hollow, so that the drum 11 has a hollow truck connected by a rod 16. The control element 12 is connected to the drum 11 and comprises a first extended member (not shown in the figure), a second extended member (not shown in the figure) and a holding portion 121. The first extended member is pivotally coupled to the first cover 13, and the second extended member is pivotally coupled to the second cover 14, and the holding portion 121 is provided for a user to hold, so that the user can use the control element to push the drum to roll.

The rod 16 can be made of a metal, a hard plastic material or an acrylic material. The elastic element 15 can be a plastic plate, a rubber plate, a sponge, a spring and any other elastic objects, and the elastic element 15 can be a sheet elastic element or a circular elastic element. The first cover 13 further comprises a switch element for controlling the first cover 13 to be switched to an open state or a closed state at an end of the drum 11. The second cover 14 further comprises a switch element for controlling the second cover 14 to be switched to an open state or a closed state at an end of the drum 11.

The first cover 13 further comprises a first control plate having a plurality of first holes and a second control plate having a plurality of second holes, and the second control plate is provided for controlling the second holes to be aligned with the first control plates, such that at least one ball can be removed from the corresponding second holes and first holes. The second cover 14 further comprises a first control plate having a plurality of first holes and a second control plate having a plurality of second holes, and the second control plate is provided for controlling the second holes to be aligned with the corresponding first holes of the first control plate, such that at least one ball can be removed from the corresponding second holes and first holes.

Figure 2:
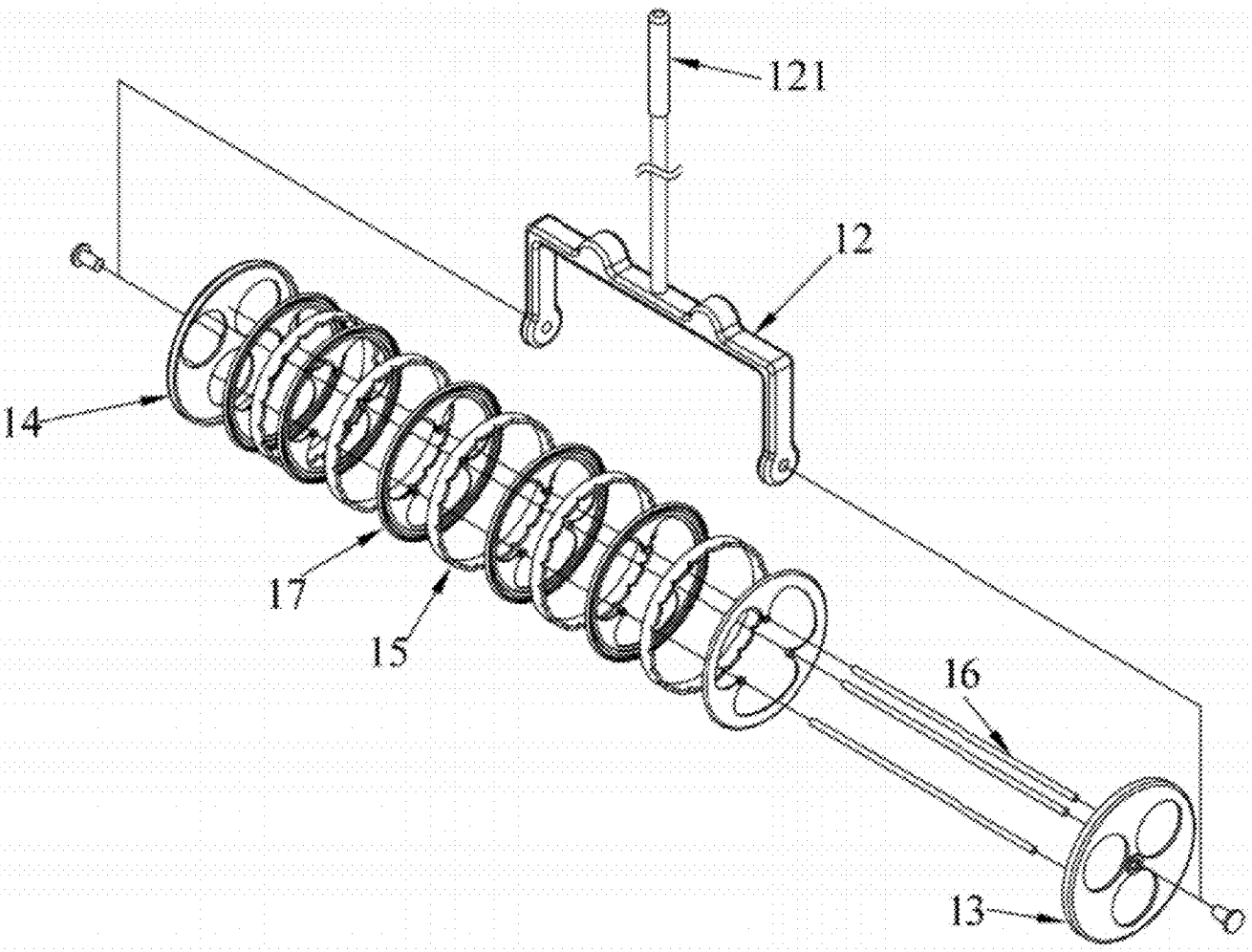
FIG. 2 an exploded view of a ball collecting device in accordance with a preferred embodiment of the present invention.
Figure 3:
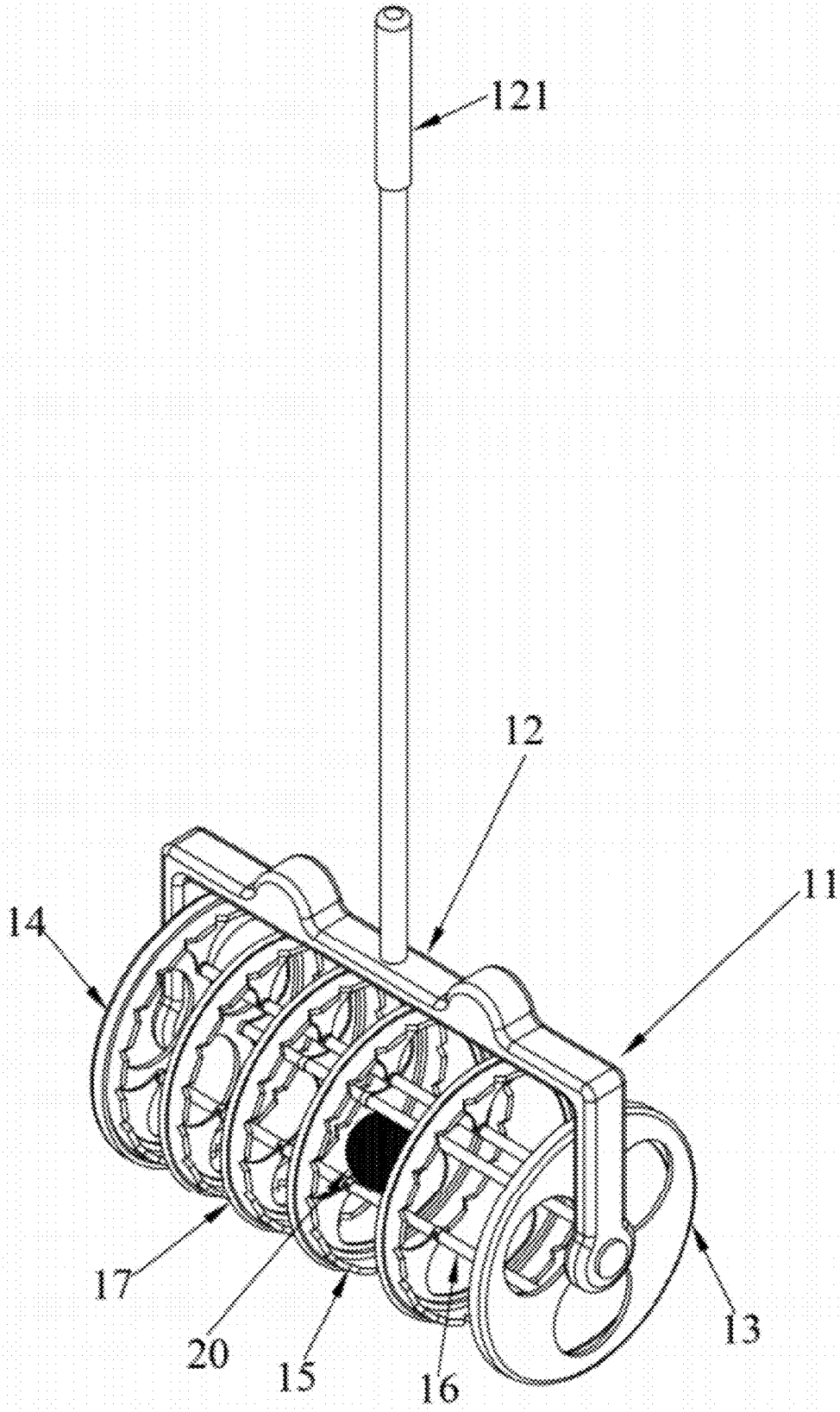
FIG. 3 is a perspective view of a ball collecting device in accordance with a preferred embodiment of the present invention.

With reference to FIGS. 2 and 3 for an exploded view and a perspective view of a ball collecting device in accordance with a preferred embodiment of the present invention respectively, the ball collecting device as shown in FIG. 2 comprises a drum 11 and a control element 12. A first cover 13 and a second cover 14 are installed at both ends of the drum 11 such that a containing space is formed in the drum 11. The drum 11 has a hollow trunk and is connected to at least one ring-shaped body 17 with an interval apart, and at least one elastic element 15 is installed around the second cover 14 and each ring-shaped body 17. At least one rod 16 is provided for connecting the first cover 13, the second cover 14 and each ring-shaped body 17. The drum 11 can be in a circular cylindrical shape to reduce the friction of a contact surface, such that when a user holds a holding portion 121 of the control element 12 to push the circular cylindrical drum 11, the drum 11 rolls quickly to achieve the power-saving effect.

If the user wants to collect balls 20 scattered all over the floor of a court, the user holds the holding portion 121 of the control element 12 to push and roll the drum 11. The drum 11 has a hollow trunk and is connected to the rod 16 with an interval apart. The interval between two adjacent ring-shaped bodies 17 is slightly larger than the diameter of the balls 20, such that the balls 20 can be passed through the intervals between the ring-shaped bodies 17 and entered into the containing space. The rod 16 can be made of a metal, a hard plastic material or an acrylic material.

At least one elastic element 15 is installed around the second cover 13 and each ring-shaped body 17, and the elastic element 15 can be a plastic plate, a rubber plate, a sponge, a spring or any other elastic objects. The elastic element 15 can be a sheet elastic element or a circular elastic element. If the elastic element 15 is a sheet elastic element, a plurality of sheet elastic elements are installed around the ring-shaped body 17. If the elastic element 15 is a circular elastic element, then a ring-shaped body 17 is installed around the circular elastic element. In addition, the elastic element 15 can be installed on a side of the ring-shaped body 17 or installed separately on both sides of the ring-shaped body 17. The balls 20 are pushed to shift the elastic elements 15 and entered into the containing space. Further, the balls 20 are forced to shift the elastic elements 15 and squeezed into the containing space for storage, so as to provide a convenient way of collecting the balls 20.

Moreover, the first cover 13 is integrally formed with the drum 11, and the first cover 13 can be a closed end of the drum 11. The second cover 14 comprises a switch element (not shown in the figure), and the switch element for controlling the second cover 14 to be switched to an open state or a closed state at an end of the drum 11. The switch element can be a threaded rotating element or a pressing movable element, and any one of the switch elements corresponds to the second cover 14. After the balls 20 are stored in the containing space, users can use the switch element to open the second cover 14 for accommodating the balls 20 into a basket or any other container, so as to provide a convenient way for training and repeated practices.

Figure 4:
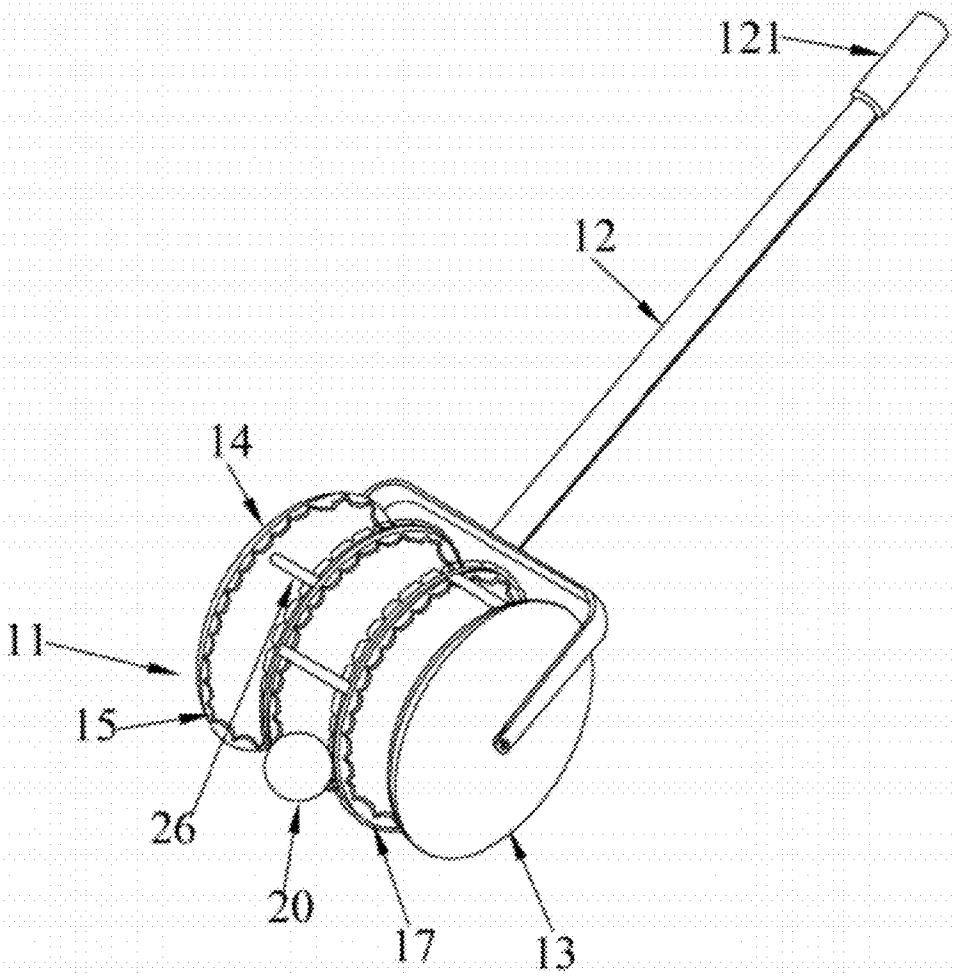
FIG. 4 is a schematic view of a ball collecting device in accordance with another preferred embodiment of the present invention.

With reference to FIG. 4 for a schematic view of a ball collecting device in accordance with another preferred embodiment of the present invention, the ball collecting device comprises a drum 11 and a control element 12. A first cover 13 and a second cover 14 are connected to both ends of the drum 11 respectively, such that a containing space is formed in the drum 11. The drum 11 has a hollow trunk and is connected to the plurality of ring-shaped bodies 17 with an interval apart, and each of the ring-shaped bodies 17 is connected to at least one elastic element 15 and at least one rod

26. The control element 12 is connected to the drum 11, and the control element 12 is provided for a user to hold and push the drum 11 to roll. The interval between two adjacent ring-shaped bodies 17 is slightly larger than the diameter of the ball 20, such that the balls 29 can be passed through the intervals between the ring-shaped bodies 17 and entered into the containing space. In addition, the ring-shaped body 17 can be made of a metal, a hard plastic material or an acrylic material. The balls 20 are forced to shift the elastic elements 15 and squeezed into the containing space for storage. The rods 26 can be used for supporting the ring-shaped bodies 17 and supporting the ring-shaped bodies 17, the first cover 13 and a second cover 14. Therefore, the invention provides a convenient device for collecting the balls 20.

While the invention has been described by means of specific embodiments, numerous modifications and variations could be made thereto by those skilled in the art without departing from the scope and spirit of the invention set forth in the claims.

What is claimed is:

1. A ball collecting device comprising:

a drum having a first cover and a second cover installed at both ends of the drum respectively to form a containing space in the drum for containing at least one ball, and a trunk of the drum being hollow and coupled to at least one ring-shaped body with an interval apart, and at least one elastic element being installed around each of the ring-shaped bodies, an interval between two adjacent said ring-shaped bodies is slightly larger than a diameter of the ball to allow the ball to pass through for entering into the containing space and wherein the first cover, the second cover, and the ring-shaped bodies are coupled by at least one rod, and the rod is made of a material selected from a group consisting of a metal, a hard plastic material and an acrylic material;

a control element coupled to the drum, allowing a user to control the drum;

wherein the first cover further comprises a first control plate having a plurality of first holes and a second control plate having a plurality of second holes, and the second control plate is provided for controlling the second holes to be aligned with the corresponding first holes of the first control plate, such that at least one ball is able to be removed from the corresponding second holes and first holes; and wherein the second cover further comprises a first control plate having a plurality of first holes and a second control plate having a plurality of second holes, and the second control plate for controlling the second holes to be aligned with the corresponding first holes of the first control plate, such that at least one ball is able to be removed from the corresponding second holes and first holes.

2. The ball collecting device of claim 1, wherein the elastic elements are sheet elastic elements or circular elastic elements.

3. The ball collecting device of claim 1, wherein the control element further comprises a holding portion for the user to hold the control element thereon.

4. The ball collecting device of claim 1, wherein the second cover comprises at least one elastic element installed around the second cover.

5. A ball collecting device comprising:

a drum having a first cover and a second cover installed at both ends of the drum respectively to form a containing space in the drum for containing at least one ball, and at least one elastic element being installed around the second cover, and the first cover and the second cover being hollow and connected by at least one rod, wherein an interval between the first cover and the second cover is slightly larger than a diameter of the ball to allow the ball to pass through for entering into the containing space, and the rod is made of a material selected from a group consisting of a metal, a hard plastic material and an acrylic material;

a control element coupled to the drum, allowing a user to control the drum;

wherein the first cover further comprises a first control plate having a plurality of first holes and a second control plate having a plurality of second holes, and the second control plate is provided for controlling the second holes to be aligned with the corresponding first holes of the first control plate, such that at least one ball is able to be removed from the corresponding second holes and first holes; and wherein the second cover further comprises a first control plate having a plurality of first holes and a second control plate having a plurality of second holes, and the second control plate for controlling the second holes to be aligned with the corresponding first holes of the first control plate, such that at least one ball is able to be removed from the corresponding second holes and first holes.

6. The ball collecting device of claim 5, wherein the elastic elements are sheet elastic elements or circular elastic elements.

7. The ball collecting device of claim 5, wherein the control element further comprises a holding portion for the user to hold the control element thereon.

8. The ball collecting device of claim 5, wherein the second cover comprises at least one the elastic element installed around the second cover.

* * * * *